United States Patent [19]

Hebert et al.

[11] Patent Number: 4,599,870

[45] Date of Patent: Jul. 15, 1986

[54] THERMOSYPHON HEAT RECOVERY

[76] Inventors: Theodore M. Hebert, 10225 Hyaleah, Tampa, Fla. 33617; Thomas H. Hebert, 14915 Nebraska, Tampa, Fla. 33612

[21] Appl. No.: 456,202

[22] Filed: Jan. 7, 1983

Related U.S. Application Data

[63] Continuation-in-part of Ser. No. 247,247, Mar. 25, 1981, Pat. No. 4,373,346.

[51] Int. Cl.[4] ..... F25B 27/02

[52] U.S. Cl. ..... 62/238.6

[58] Field of Search ..... 62/238.6, 79, 183, 506, 62/324.5

[56] References Cited

U.S. PATENT DOCUMENTS

| | | | |
|---|---|---|---|
| 4,293,323 | 10/1981 | Cohen | 62/238.6 |
| 4,330,309 | 5/1982 | Robinson, Jr. | 62/238.6 X |
| 4,350,024 | 9/1982 | Moll | 62/238.6 |
| 4,351,159 | 9/1982 | Schumacher | 62/238.6 |
| 4,356,706 | 11/1982 | Baumgarten | 62/238.6 |
| 4,386,500 | 6/1983 | Sigafoose | 62/324.5 |

FOREIGN PATENT DOCUMENTS

| | | | |
|---|---|---|---|
| 1476954 | 9/1969 | Fed. Rep. of Germany | 62/238.6 |
| 1466980 | 3/1977 | United Kingdom | 62/238.6 |

*Primary Examiner*—Lloyd L. King

[57] ABSTRACT

A thermosyphonic heat recovery unit for thermosyphonic heat transfer of heat from a hotter first fluid to a cooler second fluid comprising a heat exchanger including a first fluid conduit and a second fluid conduit, means for connecting fluids to the two conduits, a pressurized cold fluid input and hot fluid output and a mixing valve interconnected between said cold fluid input and said hot fluid output, whereby the second fluid thermosyphonically flows through said second conduit as the first fluid flows through said first conduit.

3 Claims, 4 Drawing Figures

THERMOSYPHON HEAT RECOVERY

CROSS-REFERENCE TO RELATED APPLICATIONS

This application is a continuation in part of our copending application Ser. No. 247,247, filed Mar. 25, 1981, now U.S. Pat. No. 4,373,346 entitled "Precool/-Subcool System and Condenser Therefor", the disclosure of which is hereby incorporated by reference herein.

BACKGROUND OF THE INVENTION

1. Field of the Invention

This invention relates to heat recovery units.

2. Description of the Prior Art

Presently there exist many types of heat recovery units designed to operate in combination with a vapor compression heat transfer system such as a heat pump or air conditioner. Basically, heat recovery units operate as a precooler to desuperheat the hot refrigerant gas being discharged by the compressor of the system, and transfer such heat to a fluid such as water. In some applications, the precooler heat exchanger is positioned within a large tank such that the fluid contained therein becomes heated during operation of the compressor. In other applications, a continuous supply of fluid such as water is forced through the precooler heat exchanger to desuperheat the refrigerant passing therethrough. The attached Disclosure Statement lists numerous patents which teach various types of heat recovery units. The disclosure of each of the patents listed in the Disclosure Statement is hereby incorporated by reference herein.

A major disadvantage to the former types of precoolers is their tendency to uncontrollably heat the fluid and, in the case of water, this typically produces steam. In the latter applications, a mechanical pump is necessary in order to circulate the fluid through the precooler during operation of the compressor. This necessarily precludes efficient production of hot fluid, in that some energy must be expended to drive the pump mechanism.

Therefore, it is an object of this invention to provide an apparatus and a method which overcomes the aforementioned inadequacies of the prior art devices and provides an improvement which is a significant contribution to the advancement of heat recovery art.

Another object of this invention is to provide a heat recovery unit which transfers heat from a first fluid to a second fluid.

Another object of this invention is to provide a heat recovery unit which is operable to transfer heat from a first fluid to a second fluid without the use of mechanical fluid pumps or the like.

Another object of this invention is to provide a heat recovery unit which is adaptable to recover the superheat from a vapor compression heat transfer system such as a heat pump or air conditioner.

Another object of this invention is to provide a heat recovery unit adapted to recover the heat from the discharged water from a precooler and subcooler combination such as our precooler and subcooler combination described in U.S. Pat. No. 4,373,346.

Another object of this invention is to provide a heat recovery unit which is readily adaptable to conventional hot water tanks without alteration of the hot water tank other than removing and/or replacing existing fittings and connectors.

Another object of this invention is to provide a heat recovery unit which includes a mixing valve arrangement to limit the temperature of the water being discharged from the tank for subsequent use.

Another object of this invention is to provide a heat recovery unit in which the mixing valve assembly and the heat exchanger unit are packageable as a kit to be sold to distributors for retail installation.

Another object of this invention is to provide a method for accomplishing the above stated objects of the apparatus of the present invention.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises an apparatus and method for transferring heat from a first fluid to a second fluid without utilizing any type of mechanical fluid pump or the like. More particularly, the apparatus and method of the invention is accomplished by circulating a hotter first fluid in thermal contact with a cooler second fluid in a heat exchanger such that the cooler second fluid is thermosyphonically drawn through the heat exchanger as the second fluid absorbs heat from the first fluid. This unique thermosyphoning action is particularly adaptable to heat recovery units designed to be used in combination with vapor compression heat transfer units such as heat pumps and air conditioners, or in combination with precooler and subcooler invention described in our U.S. Pat. No. 4,373,346.

The apparatus of the invention is particularly designed to be easily fitted to a conventional hot water heater. Specifically, the apparatus of the invention comprises a tube-in-tube heat exchanger which is configured to be coiled about the circumference of the hot water tank. The input and output of the fluid conduits of the heat exchanger are then easily fitted to the existing hose bib and pop-off valve openings of the tank. The apparatus further includes a mixing valve assembly which is easily incorporated within the cold and hot water supply lines to the tank. The mixing valve assembly limits the temperature of the heated water being discharged from the tank via the hot water supply line.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
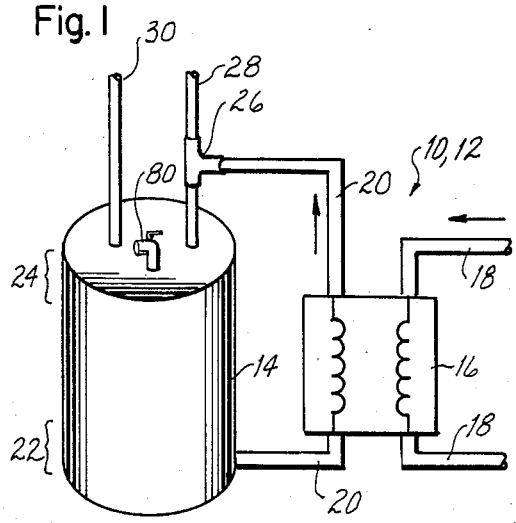
FIG. 1 is a schematic representation of the apparatus and method of the invention.

FIG. 1 is a schematic representation generally illustrating the apparatus 10 and method 12 of the invention. Basically, the method 12 of the invention comprises the steps of passing a hot fluid such as a gas or a liquid in thermal exchanging relationship with another fluid flowing to and from a storage tank 14 or the like. During operation, the hotter first fluid, being in thermal contact with the cooler second fluid, creates a thermosyphonic effect which draws the cooler second fluid from the lower region of the tank in a heat-exchanging relationship with the hotter first fluid, and then returns the second fluid to the upper region of the tank 14. The rate in which the thermosyphonic effect takes place, gradually decreases as the temperature of the second fluid within the tank 14 increases. Eventually, the temperature of the second fluid in the tank 14 will approximately equal the temperature of the first fluid at which time the thermosyphonic flow of the second fluid terminates.

The apparatus 10 of the invention basically comprises a heat exchanger 16 which connects a first conduit 18 through which the first fluid flows in a heat exchanging relationship with a second conduit 20 through which the second fluid flows. The input and output of the second conduit 20 are operatively connected in fluid communication with the lower and upper regions 22 and 24, respectively, of the tank 14 to define a closed loop circulatory path. As shown, the output of conduit 20 may be connected by a tee-fitting 26 to the hot water supply 28 of the tank. Essentially, with such an arrangement, cooler water flows into the tank 14 via the cold water supply 30 and settles in the lower region 22 of the tank 14. As the hotter first fluid flows through the heat exchanger 16 to create the thermosyphonic effect, the second fluid contained within the tank 14 circulates through the conduit 20 and causes stratification within the tank 14. At any time, heated second fluid may be removed from the tank 14 via the hot fluid supply 28. If the thermosyphonic effect is occurring during the discharge of the heated second fluid from the heat exchanger 16, the output of conduit 20 will flow directly into the hot fluid supply 28 and consumed.

It should be appreciated that the apparatus 10 and method 12 of the invention operate to heat fluid contained within the tank 14 without the necessity of any mechanical pumping action. Further, it should also be appreciated that the closed loop conduit 20 remains pressurized at the same pressure existing at the supply conduits 28 and 30. This assures that the apparatus 10 of the invention can be connected to existing tanks 14 without adversely affecting fluid pressures or the like.

Figure 2:
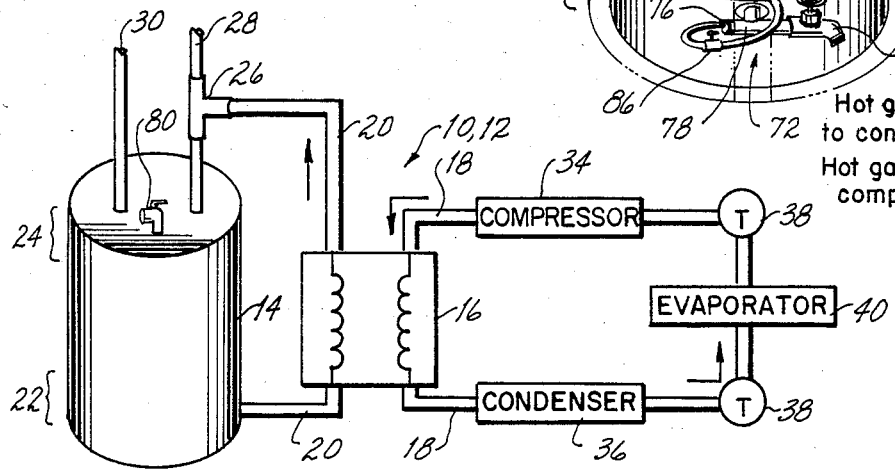
FIG. 2 is a schematic representation of the first embodiment of the apparatus and method of the invention designed to operate in combination with a vapor cycle heat transfer system.

FIG. 2 is a schematic representation which illustrates the apparatus 10 and method 12 of the invention connected and operating in conjunction with a conventional vapor compression heat transfer system 32 such as a heat pump or air conditioner. Reduced to its essential components, conventional heat transfer systems 32 comprise a compressor 34, condenser 36, throttling device 38 and evaporator 40 which are connected in serial fluid communication. During operation, the compressor 34 compresses the refrigerant contained within the circuit from a saturated-vapor state to a superheated vapor state, thereby increasing the temperature, enthalpy and pressure of the refrigerant. The refrigerant then flows through the condenser 36 which condenses the refrigerant at a substantially constant temperature to a saturated liquid state. The throttling device 38 reduces the pressure of the refrigerant thereby causing the refrigerant to change from a mixed liquid-vapor state. The refrigerant then flows through the evaporator 40 which causes the refrigerant to return at a constant pressure to its saturated-vapor state, thereby completing the thermal transfer cycle of the system 32.

In the first embodiment of the apparatus 10 of the invention, conduit 18 is connected in serial fluid communication with the refrigerant circuit of the system 32 between the compressor 34 and the condenser 36. During the operation of the heat transfer system 32, the hot refrigerant gas is discharged from the compressor 34 at a superheated vapor state and flows through conduit 18 of the heat exchanger 16 and then through the condenser 36 of the system 32. With the second fluid contained within the conduit 20 and the tank 14, the second fluid will partially desuperheat the hot refrigerant gas as it flows through the heat exchanger 16. Simultaneously, a thermosyphonic effect will be created within the heat exchanger 16, such that the second fluid is caused to circulate through the closed loop conduit 20 in the manner as described above.

Figure 3:
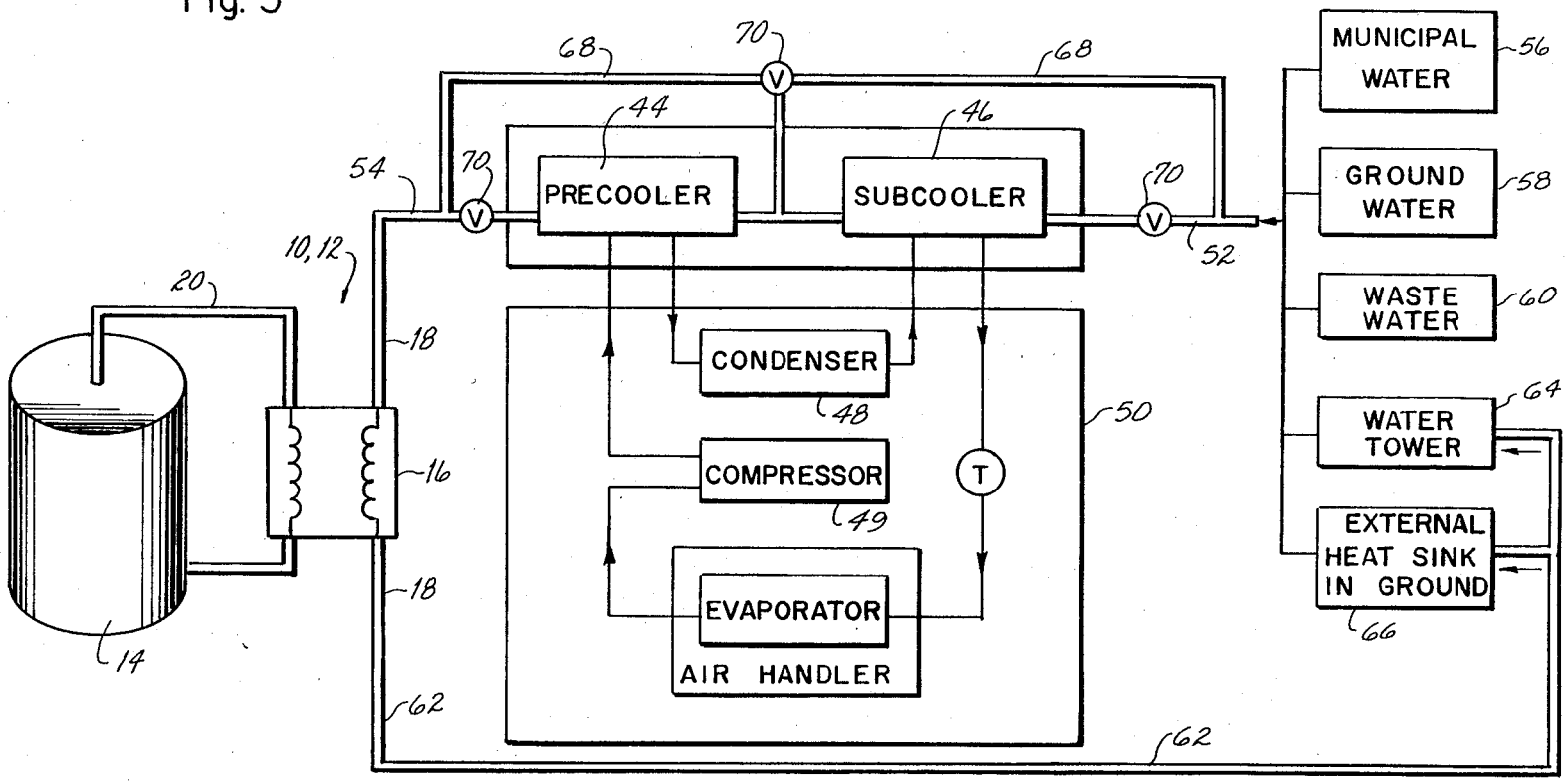
FIG. 3 is a schematic representation of a second embodiment of the apparatus and method designed to operate in combination with a precooler and subcooler combination.

FIG. 3 is a schematic representation of the apparatus 10 and method 12 of the invention incorporated in combination with a precool and subcool system 42 of our prior invention, U.S. Pat. No. 4,373,346, entitled "Precool/Subcool System and Condenser Therefor", the disclosure of which is hereby incorporated by reference herein. Basically, the precool and subcool system 42 of our prior invention comprises a precooler heat exchanger 44 and a subcooler heat exchanger 46 connected in fluid communication with the input and the output of a condenser 48 of a vapor compression heat transfer system 50 such as a heat pump or air conditioner. A cooling fluid is first flowed through the subcooler 46 and then the precooler 44 and is discharged via output conduit 54. The supply of the cooling fluid into the input conduit 52 may comprise municipal water 56, ground water 58, and/or waste water 60. Alternatively, or in combination therewith, the cooling fluid may circulate in a closed loop system via conduit 62 such that the fluid is cooled by means of a water tower 64 and/or an external heat sink and ground arrangement 66. Bypass conduits 68 and valves 70 are provided to regulate the rate at which the cooling fluid flows through the subcooler 46 and the precooler 44.

In the second embodiment of the apparatus 10 illustrated in FIG. 3, conduit 18 of the heat exchanger 16 is connected in fluid communication with the output conduit 54 of the precool and the subcool system 42. The output of conduit 18 is then discharged, or connected in fluid communication with closed loop conduit 62. During operation, the first fluid flows through the subcooler 46 to subcool the refrigerant discharged from the condenser 48, flows through the precooler 44 to precool (desuperheat) the hot gaseous refrigerant discharged from the compressor 49, and then flows through conduit 18 of the heat exchanger 16 to be in heat exchanging relationship with the fluid contained within the tank 14. As this process continues, with the first fluid either being discharged or recirculated via closed loop conduit 62, a thermosyphonic effect takes place within the heat exchanger 16 thereby causing the fluid within the tank 14 to become heated in the manner previously described.

It should be appreciated that the combination of our precool and subcool system 42 with our present thermosyphonic invention greatly increases the efficiency and economics of the system in that the former invention is primarily designed to increase the efficiency and cooling capacity of the heat transfer system 50, whereas, the latter, present invention is primarily designed to produce heated fluid such as water for domestic or commercial use.

Figure 4:
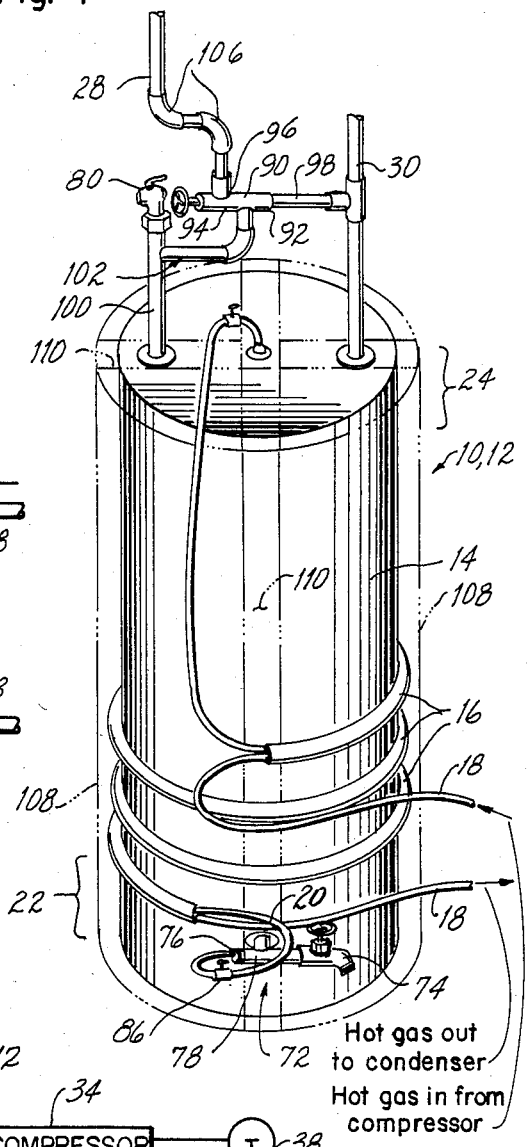
FIG. 4 is an isometric view of the preferred manner in which the apparatus of the invention is connected relative to a conventional hot water heater.

FIG. 4 is a detailed isometric view of the referred embodiment of the apparatus 10 of the invention which is designed to be installed in conjunction with a conventional hot water heater 14. Specifically, the heat exchanger 16 of the apparatus 10 comprises a tube-in-tube heat exchanger 16 which is coiled about the circumference of the tank 14. The input and output of the refrigerant conduit 18 of the tube-in-tube heat exchanger 16 is connected in serial fluid communication with the output of the compressor and the input of the condenser of the vapor pressure heat transfer system (not shown). The input of the fluid conduit 20 of the tube-in-tube heat exchanger 16 is connected in fluid communication with the existing drain 72 of the tank 14 by removing the existing hose bib 74, attaching a nipple 76 and tee-fitting 78 and then re-connecting the hose bib 74 to one end of the tee-fitting 78 while connecting the input of conduit 20 to the other end of the tee-fitting 78.

The output of fluid conduit 20 of the tube-in-tube heat exchanger 16 is connected in fluid communication with the upper region of the tank 14 by removing the existing pop-off valve 80 and then connecting the output of conduit 20 into the top of the tank by means of a compression adapter 82. A pair of needle valves 84 and 86 may be connected in-line with the input and output of conduit 20 so as to regulate the flow of the fluid through the conduit 20 and to assist in bleeding the tank of any trapped air during installation. Preferably, the output of conduit 20 extends into the upper region 24 of the tank 14 by an amount approximately equal to one-fourth ($\frac{1}{4}$) of the height of the tank 14.

The foregoing has described the preferred embodiment of the apparatus 10. However, when the apparatus 10 of the invention is used in conjunction with a vapor cycle heat transfer system such as a heat pump or air conditioner, the temperature of the water contained within the tank 14 may increase beyond a safe temperature. A potentially dangerous situation may, therefore, exist in that a the consumer may inadvertently scald himself/herself when exposed to the excessive temperature of the fluid in the tank 14. In order to eliminate the potential that such a hazard may exist, the apparatus 10 of the invention further comprises a unique mixing arrangement 88 which limits the temperature of the water flowing into the hot water supply 28.

Referring to FIG. 4, the mixing arrangement 88 comprises an adjustable mixing valve 90 having a cold water input 92, a hot water input 94, and a tempered output 96. Preferably, such a mixing valve 90 comprises a valve similar to one sold under the trademark "Watts" by the Watts Regulator Company of Lawrence, Mass., Watts Number 70A Series. These types of mixing valves 90 are standardized to be adjustable within the ranges of 100–130 degrees and 110–160 degrees. The cold water input 92 is connected in fluid communication with the existing cold water supply 30 by means of a conduit 98. The hot water input 94 is connected in fluid communication with the upper region 24 of the tank 14 by means of a vertical conduit 100 and connecting conduit 102. The pop-off valve 80, having previously been removed from the tank 14, is then fitted to the opened end of the vertical conduit 100. Preferably, the vertical conduit 100 extends into the upper region 24 of the tank 14 an appreciable distance greater than that in which the output of conduit 20 extends therein. The tempered output 96 is connected in fluid communication with the existing hot water supply conduit 28, by means of stub and elbow conduits 104 and 106.

It should be appreciated that the mixing arrangement 88 including mixing valve 90 and conduits 98, 100, 102, 104 and 106 may be factory assembled and sold as a kit along with the heat exchanger 16 to distributors for retail installation. Further, the unique mixing arrangement 88 takes advantages of all of the existing openings in the tank 14 thereby eliminating the need to create additional openings or close off existing openings in the tank 14 while still permitting the mixing arrangement 88 to be connected to the existing cold and hot water supply conduits 30 and 28, respectively.

After the installation of the heat exchanger 16 and the mixing arrangement 88, an insulation blanket 108 is wrapped about the tank 14 and the heat exchanger 16 and the seams thereof taped 110. This maximizes the heat transfer from the gaseous refrigerant and the fluid in the tank 14 while minimizing the loss of heat after the water in the tank 14 has become heated.

The present disclosure includes that contained in the appended claims, as well as that of the foregoing description. Although this invention has been described in its preferred form with a certain degress of particularity, it is understood that the present disclosure of the preferred form has been made only by way of example and that numerous changes in the details of construction and the combination and arrangements of parts may be resorted to without departing from the spirit of the invention.

Now that the invention has been described:

What is claimed is:

1. A thermosyphonic heat recovery unit for thermosyphonic heat transfer of heat from a hotter first fluid to a cooler second fluid, comprising in combination:

a heat exchanger including a first fluid conduit and a second fluid conduit connected in a heat exchanging relationship with one another;

means for connecting a pressurized source of the hotter first fluid in fluid communication with said first conduit enabling the hotter first fluid to flow through said first conduit;

means for connecting said second conduit in fluid communication with a non-pressurized source of the cooler second fluid;

said source of the second fluid comprising a tank in which the second fluid is stored;

the input and the output of said second conduit being connected in fluid communication with the lower and the upper regions, respectively, of said tank; and said tank including a pressurized cold fluid input and hot fluid output and further comprising a mixing valve interconnected in fluid communication between said cold fluid input and said hot fluid output;

whereby the second fluid thermosyphonically flows through said second conduit as the first fluid flows through said first conduit.

2. The heat recovery unit as set forth in claim 1, wherein said heat exchanger comprises a tube and tube heat exchanger which is coiled about the circumference of said tank.

3. The heat recovery unit as set forth in claim 1, further including an insulation blanket positioned about said tank and said tube-in-tube heat exchanger.

* * * * *